US008319571B2

(12) United States Patent
Breen et al.

(10) Patent No.: US 8,319,571 B2
(45) Date of Patent: Nov. 27, 2012

(54) WAVEGUIDE DISTORTION MITIGATION DEVICES WITH REDUCED GROUP DELAY RIPPLE

(75) Inventors: Richard D. Breen, Fremont, CA (US); Samuel J. Waldbaum, Sunnyvale, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 13/067,506

(22) Filed: Jun. 6, 2011

(65) Prior Publication Data

US 2011/0234339 A1 Sep. 29, 2011

Related U.S. Application Data

(63) Continuation of application No. 12/214,312, filed on Jun. 18, 2008, now abandoned.

(51) Int. Cl.
*H01P 1/32* (2006.01)

(52) U.S. Cl. ..... 333/1.1; 333/114

(58) Field of Classification Search ..... 333/1.1, 333/114, 120, 121, 122, 28 R
See application file for complete search history.

(56) References Cited

U.S. PATENT DOCUMENTS 2,939,093 A 5/1960 Marie
3,978,417 A * 8/1976 Fletcher et al. ..... 330/4
5,274,839 A 12/1993 Kularajah et al.
6,797,929 B2 9/2004 Drozd et al.
6,885,257 B2 4/2005 Kroening
7,049,900 B2 * 5/2006 Kroening ..... 333/1.1
7,176,767 B2 * 2/2007 Kroening ..... 333/1.1
7,230,507 B2 * 6/2007 Kroening ..... 333/24.2
7,242,263 B2 7/2007 Kroening
7,280,004 B2 * 10/2007 Kroening ..... 333/1.1
7,561,003 B2 * 7/2009 Kroening ..... 333/1.1

OTHER PUBLICATIONS

Jul. 7, 2010 Office Action issued in U.S. Appl. No. 12/214,312.
Dec. 6, 2010 Office Action issued in U.S. Appl. No. 12/214,312.

* cited by examiner

*Primary Examiner* — Dean O Takaoka
*Assistant Examiner* — Alan Wong
(74) *Attorney, Agent, or Firm* — Oliff & Berridge, PLC

(57) ABSTRACT

Disclosed are waveguide distortion mitigation devices that produce reduced group delay ripple in communication systems in which they are used. The devices comprise a first and second tapered waveguide sections, a first coupling device coupled to the first tapered waveguide section, and a second coupling device coupled to the second tapered waveguide section and the first waveguide coupling device. A waveguide isolator may optionally be coupled between the first and second waveguide coupling devices. The first and second coupling devices may comprise waveguide circulators or waveguide-hybrid couplers. The tapered waveguide sections may embody a single transition comprising a single waveguide wall, a single transition comprising two waveguide walls, or a plurality of transitions comprising a plurality of waveguide walls.

13 Claims, 3 Drawing Sheets

WAVEGUIDE DISTORTION MITIGATION DEVICES WITH REDUCED GROUP DELAY RIPPLE

This is a Continuation of application Ser. No. 12/214,312 filed Jun. 18, 2008. The disclosure of the prior application is hereby incorporated by reference herein in its entirety.

BACKGROUND

The present invention relates generally to waveguide distortion mitigation, and more particular, to waveguide distortion mitigation devices having reduced group delay ripple.

The problem of reducing group delay distortion in communication systems has been conventionally solved using a single waveguide group delay equalization device having a multitude of tuning screws that are used to minimize the resultant group delay ripple. Alternatively, conventional approaches attempt to reduce the group delay ripple by utilizing an electrically-long group delay equalization device, also used in conjunction with the aforementioned tuning screws.

However, equalization of waveguide group delay distortion using conventional approaches results in excessive group delay ripple. There is a need for improved waveguide distortion mitigation devices that produce reduced group delay ripple in communication systems in which they are employed.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

As was mentioned above, equalization of waveguide group delay distortion using conventional approach results in excessive group delay ripple. To overcome this, disclosed are devices that equalize the group delay distortion, but with minimal delay ripple over the frequency band of interest. The resultant group delay ripple is typically much less than that exhibited by conventional devices.

The problems experienced by conventional equalizers is solved by utilizing multiple group delay equalization devices that work as one to minimize the aggregate group delay ripple experienced by the communication system. A minimum of two devices in series are typically required, but several may be used, as necessary, for the purpose of minimizing waveguide distortion over the frequency band of interest. Each device is uniquely designed to work in unison with the other devices so as to precisely reduce the group delay ripple while fully mitigating the signal distortion due to the waveguide induced group delay.

Figure 1A:
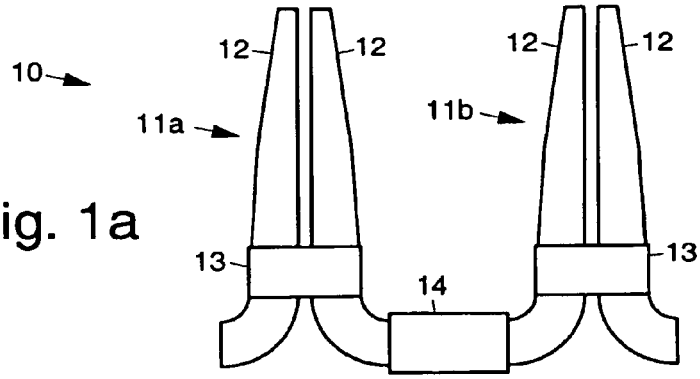
FIGS. 1*a* and 1*b* illustrate exemplary waveguide distortion mitigation devices.
Figure 1B:
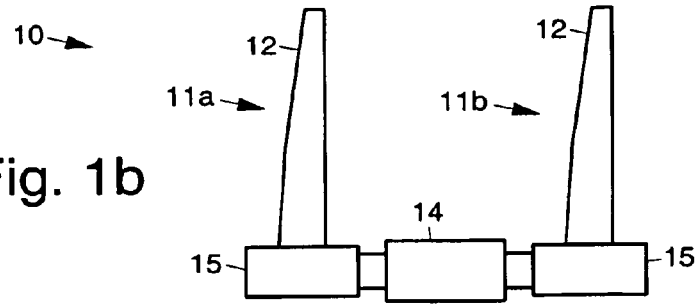
Figure 2A:
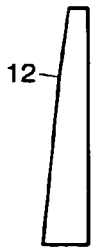
FIGS. 2*a*-2*d* illustrate exemplary tapered waveguide designs.
Figure 2B:
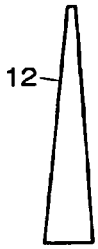
Figure 2C:
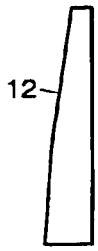
Figure 2D:
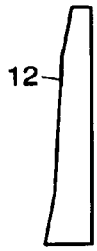

Referring to the drawing figures, there are at least two general approaches to effectively mitigate the waveguide distortion while minimizing the resultant group delay ripple. FIGS. 1*a* and 1*b* illustrate two exemplary waveguide distortion mitigation devices 10 that minimize group delay ripple.

The waveguide distortion mitigation device 10 shown in FIG. 1*a* utilizes first tapered waveguide apparatus 11*a* comprising a first set of two substantially identical tapered waveguide sections 12, integrated using a first coupling device 13 comprising waveguide-hybrid coupler 13. The first tapered waveguide apparatus 11*a* is coupled in series with a second tapered waveguide apparatus 11*b* comprising a second set of two substantially identical tapered waveguide sections 12, which are integrated using a second coupling device 13, or waveguide-hybrid coupler 13. A waveguide isolator 14, disposed between the first and second tapered waveguide apparatus 11*a*, 11*b*, is optional, and may not be required in all cases.

The waveguide distortion mitigation device 10 shown in FIG. 1*b* is a slight variation of the device 10 shown in FIG. 1*a*. The first tapered waveguide apparatus 11*a* comprises a single tapered waveguide section 12, and it is coupled to a first coupling device 15 comprising a waveguide circulator 15, instead of the waveguide-hybrid coupler 13. Similarly, the second tapered waveguide apparatus 11*b* comprises a single tapered waveguide section 12, and it is also coupled to a second coupling device 15 comprising a waveguide circulator 15. As was the case for the waveguide distortion mitigation device 10 shown in FIG. 1*a*, a waveguide isolator 14 is optional, but may be used in certain cases for enhanced electrical performance.

The tapered waveguide sections 12 used in the waveguide distortion mitigation devices 10 shown in FIGS. 1*a* and 1*b* may have various designs, some of which are shown in FIGS. 2*a*-2*d*. A first design for the tapered waveguide sections 12 utilize a single transition from the input of the section 12 to a final tapered region, and with the transition accomplished using a single waveguide wall. A second design is similar to the first, but the single transition is accomplished using two waveguide walls. Third and fourth designs use more than one transition between the input of the waveguide section 12 and the final tapered regions. The decision as to which tapered waveguide design to use in the distortion mitigation devices 10 shown in FIG. 1*a* or 1*b* depends upon the given characteristics of the waveguide distortion that is be corrected for in the communication system in which they are used.

Operation of the waveguide distortion mitigation devices 10 is described with reference to FIGS. 3-6.

Figure 3:
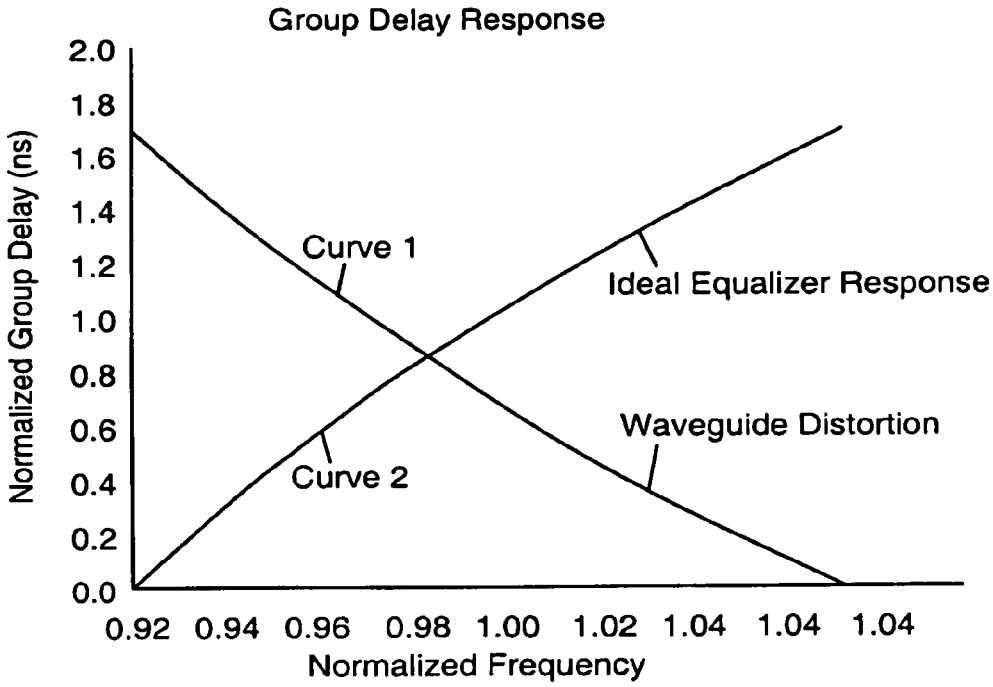
FIG. 3 is a graph that illustrates group delay distortion that originates from a given length of rectangular or circular waveguide.

FIG. 3 is a graph that illustrates group delay distortion that originates from a given length of rectangular or circular waveguide. Curve 1 of FIG. 3 illustrates the group delay distortion that originates from a given length of rectangular or circular waveguide. Curve 2 of FIG. 3 shows the group delay distortion of an ideal (i.e., non-realizable or theoretical) distortion mitigation device that has been designed to mitigate or cancel out the distortion shown in Curve 1. The goal of a design engineer is to design and fabricate a working device 10 that most closely matches the response shown in Curve 2 of FIG. 3, with a minimum amount of group delay ripple in the resultant group delay response.

Figure 4:
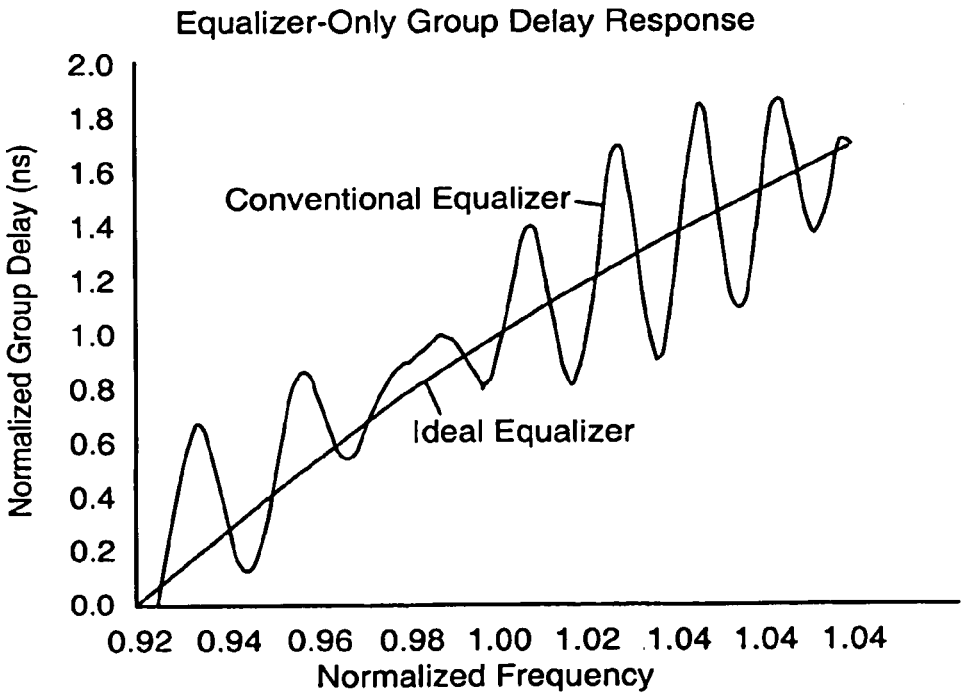
FIG. 4 is a graph that illustrates the group delay response of an ideal equalizer overlaid with the resultant group delay response of a conventional approach to mitigation of the waveguide distortion.

FIG. 4 is a graph that illustrates the group delay response of an ideal equalizer overlaid with the resultant group delay response of a conventional approach to mitigation of the waveguide distortion. In particular, the group delay response of the ideal equalizer (Curve 2 of FIG. 3) is shown in FIG. 4. Also shown in FIG. 4 is the overlaid resultant group delay response of a conventional approach to mitigating the given waveguide distortion. As can be seen, there are prominent group delay ripples across the frequency band. These large group delay ripples may cause serious problems in the communication system.

Figure 5:
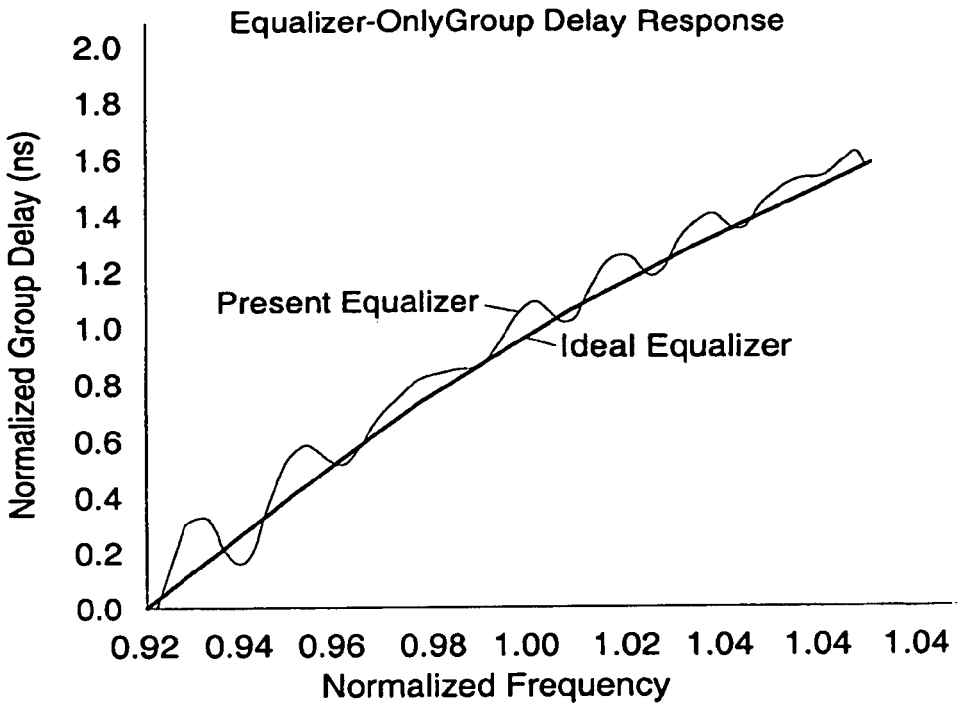
FIG. 5 is a graph that illustrates the group delay response of an ideal waveguide distortion mitigation device overlaid with the group delay response of the waveguide distortion mitigation device disclosed herein.

FIG. 5 is a graph that illustrates the group delay response of an ideal waveguide distortion mitigation device overlaid with the group delay response of the waveguide distortion mitigation device 10 disclosed herein. In particular, FIG. 5 shows the group delay response from an ideal waveguide distortion mitigation device, overlaid with the group delay response of the present approach. As may be seen in FIG. 5, the group delay ripples are significantly reduced across the frequency band, therefore resulting in a more stable communication system.

Figure 6:
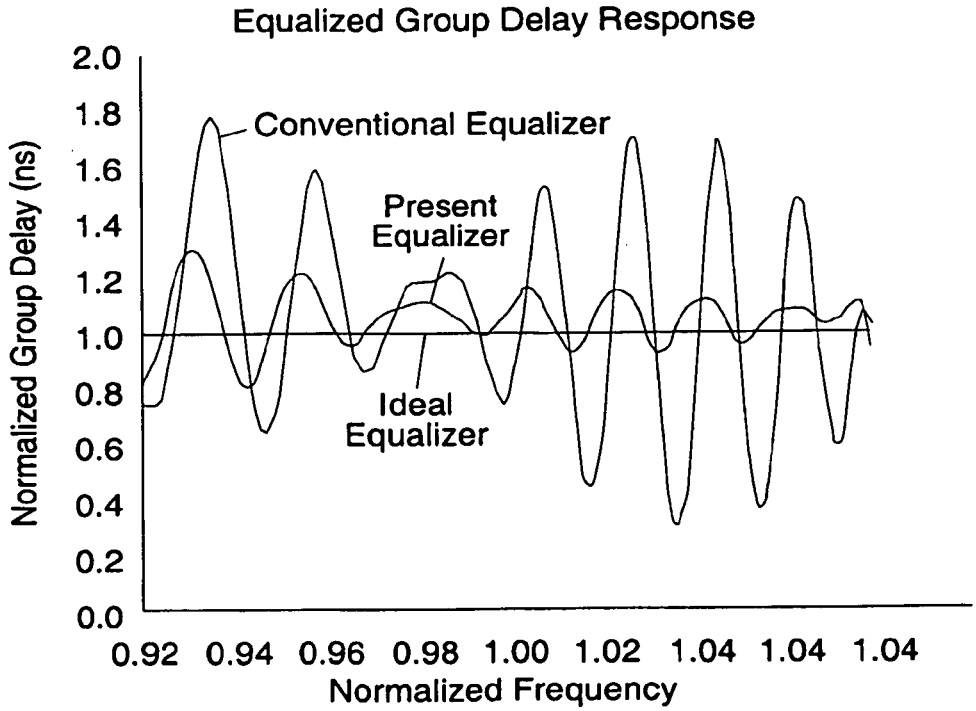
FIG. 6 is a graph that illustrates the resultant group delay response from an ideal waveguide distortion mitigation device overlaid with the group delay response of a conventional waveguide distortion mitigation device and the waveguide distortion mitigation device disclosed herein.

Finally, FIG. 6 is a graph that illustrates the resultant group delay response when equalizing waveguide distortion. In particular, FIG. 6 shows the resultant group delay response from the ideal, conventional and presently disclosed waveguide distortion device 10 summed with the waveguide distortion shown in Curve 1 of FIG. 3. It can be seen that the presently disclosed approach to waveguide distortion mitigation more closely matches that of the ideal or theoretical device compared to the conventional approach.

Thus, improved waveguide distortion mitigation devices that produce reduced group delay ripple in communication systems in which they are employed, have been disclosed. It is to be understood that the above-described embodiments are merely illustrative of some of the many specific embodiments that represent applications of the principles discussed above. Clearly, numerous and other arrangements can be readily devised by those skilled in the art without departing from the scope of the invention.

What is claimed is:

1. Apparatus comprising:
a first tapered waveguide section;
a first coupling device coupled to the first tapered waveguide section;
a second tapered waveguide section; and
a second coupling device coupled to the second tapered waveguide section and to the first waveguide coupling device, wherein each tapered waveguide section has a plurality of transitions from an input of the section to a final tapered region, and wherein the transitions comprise a plurality of waveguide walls.

2. The apparatus recited in claim 1 further comprising a waveguide isolator coupled between the first and second waveguide coupling devices.

3. The apparatus recited in claim 1 wherein the first and second coupling devices comprise first and second waveguide circulators.

4. The apparatus recited in claim 1 further comprising
a third tapered waveguide section;
a fourth tapered waveguide section;
wherein the first coupling device comprises a first waveguide-hybrid coupler coupled to the first and third tapered waveguide sections; and
wherein the second coupling device comprises a second waveguide-hybrid coupler coupled to the second and fourth tapered waveguide sections.

5. The apparatus recited in claim 4 further comprising a waveguide isolator coupled between the first and second waveguide-hybrid couplers.

6. Apparatus comprising:
a first tapered waveguide section;
a first waveguide circulator coupled to the first tapered waveguide section;
a second tapered waveguide section; and
a second waveguide circulator coupled to the second tapered waveguide section and to the first waveguide circulator, wherein each tapered waveguide section has a plurality of transitions from an input of the section to a final tapered region, and wherein the plurality of transitions comprise a plurality of waveguide walls.

7. The apparatus recited in claim 6 further comprising a waveguide isolator coupled between the first and second waveguide circulators.

8. Apparatus comprising:
first and second tapered waveguide sections;
a first waveguide-hybrid coupler coupled to the first and second tapered waveguide sections;
third and fourth tapered waveguide sections; and
a second waveguide-hybrid coupler coupled to the third and fourth tapered waveguide sections.

9. The apparatus recited in claim 8 further comprising a waveguide isolator coupled between the first and second waveguide-hybrid couplers.

10. The apparatus recited in claim 8 wherein each tapered waveguide section has a single transition from an input of the section to a final tapered region, and wherein the single transition comprises a single waveguide wall.

11. The apparatus recited in claim 8 wherein each tapered waveguide section has a single transition from an input of the section to a final tapered region, and wherein the single transition comprises two waveguide walls.

12. The apparatus recited in claim 8 wherein each tapered waveguide section has a plurality of transitions from an input of the section to a final tapered region, and wherein the plurality of transitions comprise a plurality of waveguide walls.

13. Apparatus comprising:
a first tapered waveguide section;
a first coupling device directly connected to the first tapered waveguide section;
a second tapered waveguide section;
a second coupling device directly connected to the second tapered waveguide section, wherein each tapered waveguide section has a plurality of transitions from an input of the section to a final tapered region, and wherein the transitions comprise a plurality of waveguide walls; and
a waveguide isolator connecting between the first and second coupling devices.

* * * * *